US007445040B2

(12) United States Patent
Szulman et al.

(10) Patent No.: US 7,445,040 B2
(45) Date of Patent: Nov. 4, 2008

(54) HEAT EXCHANGE FIN AND THE PRODUCTION METHOD THEREOF

(75) Inventors: Claire Szulman, Meudon (FR); Etienne Werlen, Paris (FR); Fabienne Chatel, Chicago, IL (US)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 369 days.

(21) Appl. No.: 10/502,123

(22) PCT Filed: Jan. 10, 2003

(86) PCT No.: PCT/FR03/00077

§ 371 (c)(1),
(2), (4) Date: Jul. 16, 2004

(87) PCT Pub. No.: WO03/060413

PCT Pub. Date: Jul. 24, 2003

(65) Prior Publication Data

US 2005/0121181 A1 Jun. 9, 2005

(30) Foreign Application Priority Data

Jan. 17, 2002 (FR) ..... 02 00542

(51) Int. Cl.
*F28B 1/00* (2006.01)

(52) U.S. Cl. ..... 165/110; 165/152; 165/166; 165/913; 62/290; 29/890.03

(58) Field of Classification Search ..... 165/109.1, 165/110, 166
See application file for complete search history.

(56) References Cited

U.S. PATENT DOCUMENTS 3,457,990 A * 7/1969 Theophilos et al. ..... 165/133
3,523,577 A 8/1970 Milton
3,542,124 A * 11/1970 Bridgnell et al. ..... 165/166
4,715,431 A * 12/1987 Schwarz et al. ..... 165/110

(Continued)

FOREIGN PATENT DOCUMENTS

DE 38 43 688 A1 11/1989

(Continued)

OTHER PUBLICATIONS

Patent Abstracts of Japan; publication No. 09159313; publication date Jun. 20, 1997; application date Dec. 8, 1995; application No. 07320339; and JP 9-159313.

(Continued)

*Primary Examiner*—Allen J Flanigan
(74) *Attorney, Agent, or Firm*—Elwood Haynes

(57) ABSTRACT

A heat exchange fin spacer. The fin may be sandwiched between two plates in a brazed-plate heat exchanger. The fin is based upon a corrugated product having wave legs which, when mounted, define flow channels for a gas to be condensed. The fin has at least one condensed liquid drainage channel on the wave legs and deviation elements that drain the liquid towards at least one lateral edge of the wave legs. The deviation elements are provided with at least one leading edge and/or at least one inclined trailing edge. The invention is suitable for use in the main heat exchanger of an air separation unit.

33 Claims, 7 Drawing Sheets

U.S. PATENT DOCUMENTS

| | | | | |
|---|---|---|---|---|
| 4,899,808 | A * | 2/1990 | Gregory et al. | 165/166 |
| 5,078,207 | A * | 1/1992 | Asano et al. | 165/166 |
| 6,374,636 | B1 * | 4/2002 | Thonnelier et al. | 62/643 |
| 6,729,388 | B2 | 5/2004 | Emrich et al. | |
| 2001/0027857 | A1 * | 10/2001 | Emrich et al. | 165/109.1 |
| 2002/0011331 | A1 * | 1/2002 | Lehman et al. | 165/166 |

FOREIGN PATENT DOCUMENTS

| | | | |
|---|---|---|---|
| EP | 0 952 419 | A1 | 10/1999 |
| FR | 2 804 471 | A1 | 8/2001 |
| GB | 2 175 990 | | 12/1986 |
| GB | 2 199 933 | | 7/1988 |

OTHER PUBLICATIONS

Patent Abstracts of Japan; publication No. 58041637; publication date Mar. 10, 1983; application date Sep. 3, 1981; application No. 56137751; and JP 58-41637.

International Search Report for PCT/FR03/00077.

Patent Abstracts of Japan; publication No. 11108458; publication date Apr. 23, 1999; application No. 09290343; application date Oct. 6, 1997.

Patent Abstracts of Japan; publication No. 05157447; publication date Jun. 22, 1993; application No. 03322128; application date Dec. 5, 1991.

Patent Abstracts of Japan; publication No. 09138088; publication date May 27, 1997; application No. 07295162; application date Nov. 14, 1995.

* cited by examiner

HEAT EXCHANGE FIN AND THE PRODUCTION METHOD THEREOF

BACKGROUND

The present invention relates to a heat-exchange spacer fin intended to be sandwiched between two plates that define a condensation passage of a brazed-plate heat exchanger, of the type comprising a corrugated product, especially with a corrugation of rectangular cross section, having corrugation legs which, in the fitted state, define flow channels for a gas to be at least partly condensed, comprising at least one drainage channel for liquid condensed on the corrugation element legs, extending along a lateral edge of the corrugation element leg, and deflection members placed on the corrugation element leg and designed to deflect condensed liquid toward this drainage channel.

The invention applies in particular to the main condenser-reboilers of double air distillation columns, which vaporize liquid oxygen by the condensation of gaseous nitrogen, to the condenser-reboilers of triple air distillation columns and to the condenser-reboilers of argon columns.

These condenser-reboilers operate for example in thermosiphon mode.

Condenser-reboilers operating in thermosiphon mode comprise an exchanger body, which is more or less completely immersed in a bath of liquid oxygen. The exchanger body consists of a stack of vertical rectangular plates, of corrugated spacers comprising heat-exchange fins, and of closure bars, which define a plurality of first passages and a plurality of second passages. The first passages are condensation passages for a heating fluid. The second passages are vaporization passages for a refrigerating fluid, which are open at the top and at the bottom and are provided with corrugated spacer fins along the vertical main direction. The exchanger body furthermore includes heating-fluid inlet and outlet boxes which sit on top of the rows of inlet and outlet windows emerging into the first passages. Liquid oxygen penetrates the second passages via the bottom, is heated in these passages up to its bubble point and then is partially vaporized.

Gaseous nitrogen penetrates the first passages via the top, gives up heat to the oxygen circulating in the second passages and is condensed. Consequently, a film of liquid nitrogen is established on the surface of the fin and flows downward. The flow is referred to as a "falling film".

The resistance to heat transfer, in falling-film condensation, is substantially proportional to the thickness of the liquid film. Given that the resistance varies with the ⅓ power of the flow rate, it rapidly increases at the points of nitrogen condensation and thus reduces the capacity for heat exchange between the gaseous nitrogen and the fin.

The object of the invention is to propose a heat-exchange fin for a condensation passage that has an increased capacity for heat exchange.

SUMMARY

For this purpose, the subject of the invention is a heat-exchange spacer fin of the aforementioned type, characterized in that at least one deflection member has a leading edge and/or a trailing edge that is inclined toward an associated drainage channel.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
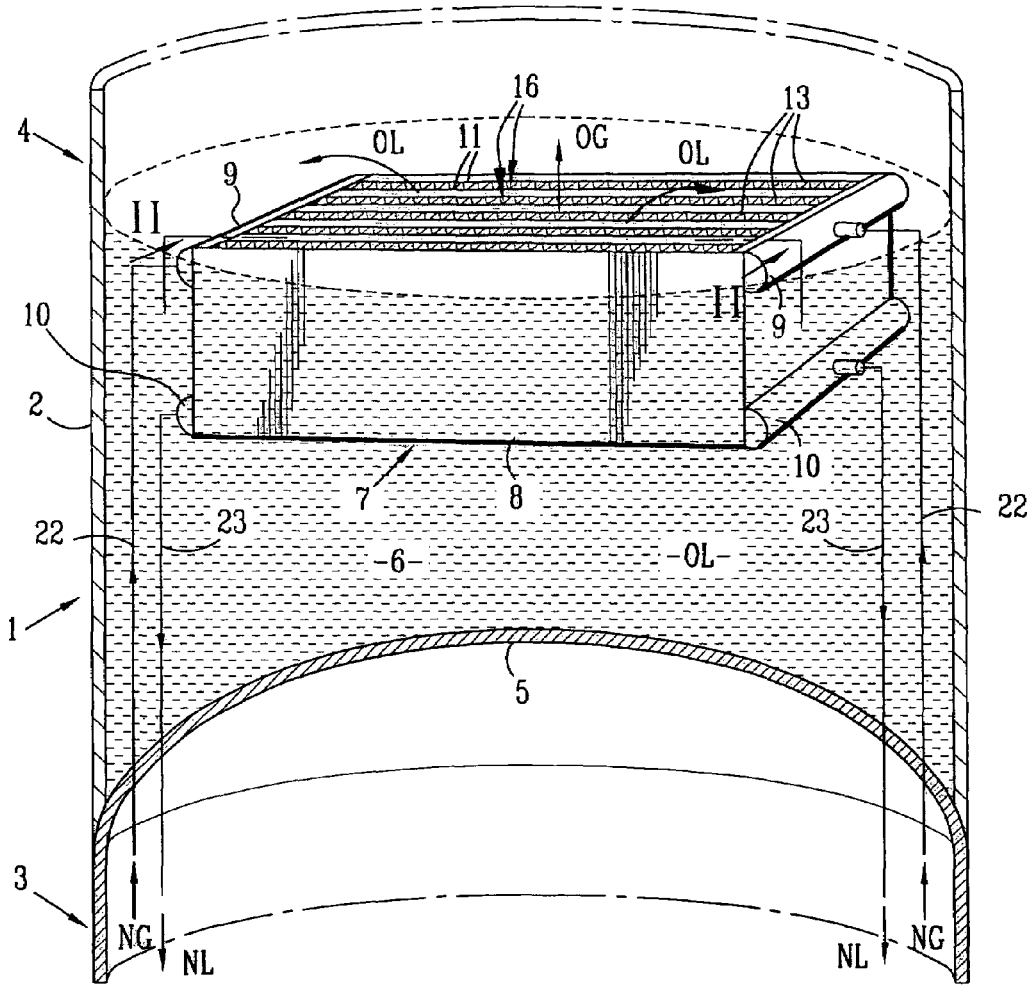
FIG. 1 illustrates schematically part of a double air distillation column.

The subject of the invention is a heat-exchange spacer fin of the aforementioned type, characterized in that at least one deflection member has a leading edge and/or a trailing edge that is inclined toward an associated drainage channel.

The spacer fin according to the invention may include one or more of the following features, taken individually or in any other technically possible combinations:

- the angle between the leading edges and the general liquid flow direction is between 5° and 70°, preferably between 10° and 45°;
- the angle between the trailing edges and the general liquid flow direction is between 5° and 70°, preferably between 10° and 45°;
- the deflection members of each corrugation element leg are designed to drain the liquid toward a single lateral edge of the corrugation element leg and the deflection members of two successive corrugation element legs are designed to drain the liquid toward two opposed lateral edges;
- the deflection members are designed to drain the liquid condensed on each of the corrugation element legs toward the two lateral edges;
- the corrugation element legs have, over their entire height with the exception of the regions associated with a drainage channel, deflection members;
- the spacer fin comprises corrugation element bottoms and corrugation element tops and the deflection members comprise first and second members, the first of which are inclined toward a drainage channel associated with the corrugation element bottom and the second of which are inclined toward a drainage channel associated with the corrugation element top;
- the successive members of two corrugation element legs consist only of first members on one of the two corrugation element legs and only of second members on the other of these two corrugation element legs;

each corrugation element leg comprises a first group of first successive members and a second group consisting of second successive members, the first and second members each extending over substantially the entire height of the corrugation element legs;

said first and said second members are symmetrical with respect to the mid-line of the corrugation element leg;

said first members are offset with respect to said second members along the general liquid flow direction, especially by one half of the distance between two successive first or second members;

said first and second members lie opposite each other, one on one side of the mid-line and the other on the other side thereof, especially so as to form a chevron;

in the unfolded state of the spacer fin, the deflection members of the corrugation element legs form rows lying parallel to one edge of the spacer fin and perpendicular to the edges of corrugation element legs and the deflection members of a row are identical;

the deflection members have a leading edge and a trailing edge and at least the leading edge and preferably the leading edge and the trailing edge are at all points inclined and directed toward the associated drainage channel;

the deflection members include a slot which is made in the corrugation element leg;

the deflection members include a projecting part on the surface of the corrugation element leg or a part set back with respect to the surface of the corrugation element leg, especially a dished part;

each gas flow channel has on the two lateral faces consisting of corrugation element legs only projecting parts or, on the two lateral faces, only parts setback with respect to the surfaces of these corrugation element legs;

two successive deflection members on a corrugation element leg are separated from each other, along said general liquid flow direction, by a distance of less than 5 cm, preferably of less than 20 mm;

the drainage channel comprises a strip of continuous material of the corrugation element leg adjacent to the deflection members and a strip of continuous material on the corrugation element top or the corrugation element bottom adjacent to the corrugation element leg;

the general liquid flow direction is substantially identical to the general fluid flow direction in the gas flow channels;

the spacer fin comprises partially offset corrugations and the distance between two successive offsets has a length of at least 3 mm and preferably of at least 1 cm; and the spacer fin comprises at least two fin parts, each of which has a different drainage capacity, and the drainage capacity increases from one fin part to the next fin part in the general fluid flow direction.

The subject of the invention is also a brazed-plate heat exchanger comprising plates that define, between them, heating passages and partial or complete condensation passages of flat general shape, and comprising, in each condensation passage, a heat-exchange spacer fin, and also lateral closure bars, characterized in that at least one heat-exchange spacer fin is a spacer fin as defined above.

The heat exchanger may constitute a condenser-reboiler of an air distillation unit.

The subject of the invention is also a process for the manufacture of a heat-exchange fin as defined above, characterized in that it comprises the following successive steps:

parallel rows of deflection members are made in a blank of flat product, especially sheet metal; and the flat product is plastically bent, forming corrugations, in such a way that the deflection members of a row are located on the corrugation element legs.

According to one particular method of implementation, the process is characterized in that:

first branches of the chevron are made in the blank; and then second branches of the chevron are made in the blank.

Shown schematically in FIG. 1 is the intermediate part of a double air distillation column 1. The shell 2 of the double column, common to the medium-pressure column 3 and to the low-pressure column 4 that is superposed on it may be seen. The domed upper end wall 5 of the column 3 separates the two columns and retains in the bottom of the column 4 a bath of liquid oxygen 6. The overhead nitrogen in the column 3 is condensed by indirect heat exchange with the liquid oxygen in the main condenser-reboiler 7 of the double column, which is placed in the bottom of the column 4 and is completely immersed in the bath 6.

The condenser-reboiler 7 consists of a parallelepipedal exchanger body 8, generally made of aluminum or aluminum alloy, and of four nitrogen inlet/outlet boxes of semicylindrical general shape, two of which are upper inlet boxes 9 and two of which are lower outlet boxes 10.

The body 8 consists of a stack of a large number of vertical rectangular plates 11, all identical. Interposed between these plates are, on the one hand, peripheral closure bars 12 and, on the other hand, corrugated spacers, namely heat-exchange corrugation elements 13 of vertical principal orientation.

The body 8 is assembled in a single operation by furnace brazing, and the four boxes 9 and 10 are welded to this body.

A large number of flat passages are thus defined between the plates 11, alternately nitrogen condensation first passages 15 and oxygen vaporization second passages 16.

Figure 2:
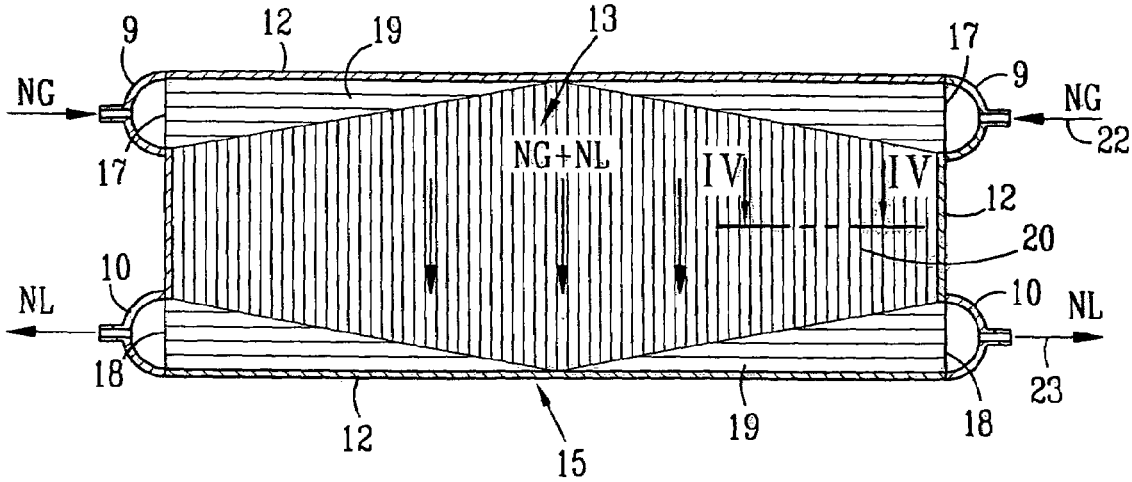
FIG. 2 illustrates a sectional view of the condenser-reboiler of this double column, taken in vertical section in the plane II-II of FIG. 1.

The first passages 15 (FIG. 2) are closed around their entire perimeter by the bars 12, which however leave free, at each longitudinal end, a gaseous nitrogen inlet upper window 17 and a liquid nitrogen outlet lower window 18.

Each first passage contains four distribution regions, associated respectively with the four windows 17 and 18. Each of these regions contains a distribution corrugation element 19 of horizontal principal orientation. The rest of the first passage 15, which extends over the great majority of its surface, is occupied by a heat-exchange corrugation element 13 consisting of a first heat-exchange spacer fin 20. This spacer fin 20 is sandwiched between two plates 11.

Each of the two nitrogen inlet boxes 9 sits on top of a horizontal row of windows 17. Likewise, each of the two nitrogen outlet boxes 10 sits on top of a horizontal row of windows 18.

The second passages 16 are entirely open on their upper and lower sides and they are closed on their two vertical sides, over their entire height, by the closure bars 12. They contain only exchange corrugation elements 13 consisting of a second heat-exchange fin. These fins may be of corrugated sheet metal with a smooth surface.

In operation, gaseous nitrogen, coming from the column 3 via lines 22, is introduced into the first passages 15 via the two boxes 9, is distributed over the entire length of the first passages by the upper corrugation elements 19 and condenses on the surface of the first heat-exchange spacer fins 20. The liquid nitrogen thus obtained, which is collected in the two boxes 10 by the lower corrugation elements 19, is sent back as reflux into the column 3 via lines 23.

Gaseous nitrogen flows through the condenser-reboiler 7 in a general nitrogen flow direction V, which in this case is vertical.

Condensation of the nitrogen causes liquid oxygen to vaporize in the second passages 16.

Figure 3:
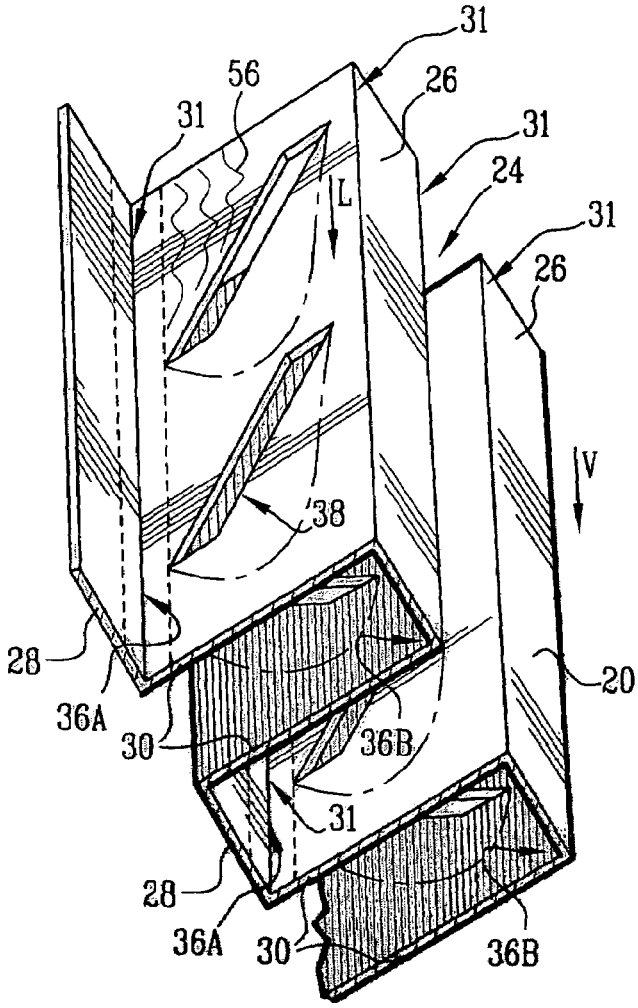
FIG. 3 illustrates a perspective view of part of a heat-exchange fin.

FIG. 3 shows, seen in perspective, part of a first heat-exchange spacer fin 20.

This fin 20 comprises a corrugation 24 of rectangular cross section, having a corrugation pitch $P_0$ and consisting of corrugation element bottoms 26 and corrugation element tops 28 joined by corrugation element legs 30. Each corrugation element leg 30 has two lateral sides 31 extending along the corrugation element bottoms 26 or tops 28. As may be seen in FIG. 4, the corrugation element bottoms 26 and corrugation element tops 28 are fixed over their width $I_0$ respectively to two plates 11 by a layer of braze 32. The corrugation element legs 30 extend between these two plates 11 and have a height $h_0$. Thus, the fin 20 and the plates 11 define gaseous nitrogen flow channels 34. Typically the height $h_0$ is between 3 mm and 10 mm and the width Iis between 0.5 mm and 5 mm.

The fin 20 comprises means for draining liquid nitrogen condensed on the surface of the legs 30 of the fin toward the corners of the fin.

These drainage means comprise, on the one hand, first drainage channels 36A and 36B and, on the other hand, members 38 for deflecting condensed liquid toward these drainage channels 36.

Each of the first drainage channels 36A is formed by the junction of a corrugation element leg 30 with a corrugation element top 28, while each of the first drainage channels 36B is formed by the junction of a corrugation element leg 30 with a corrugation element bottom 28.

Figure 5:
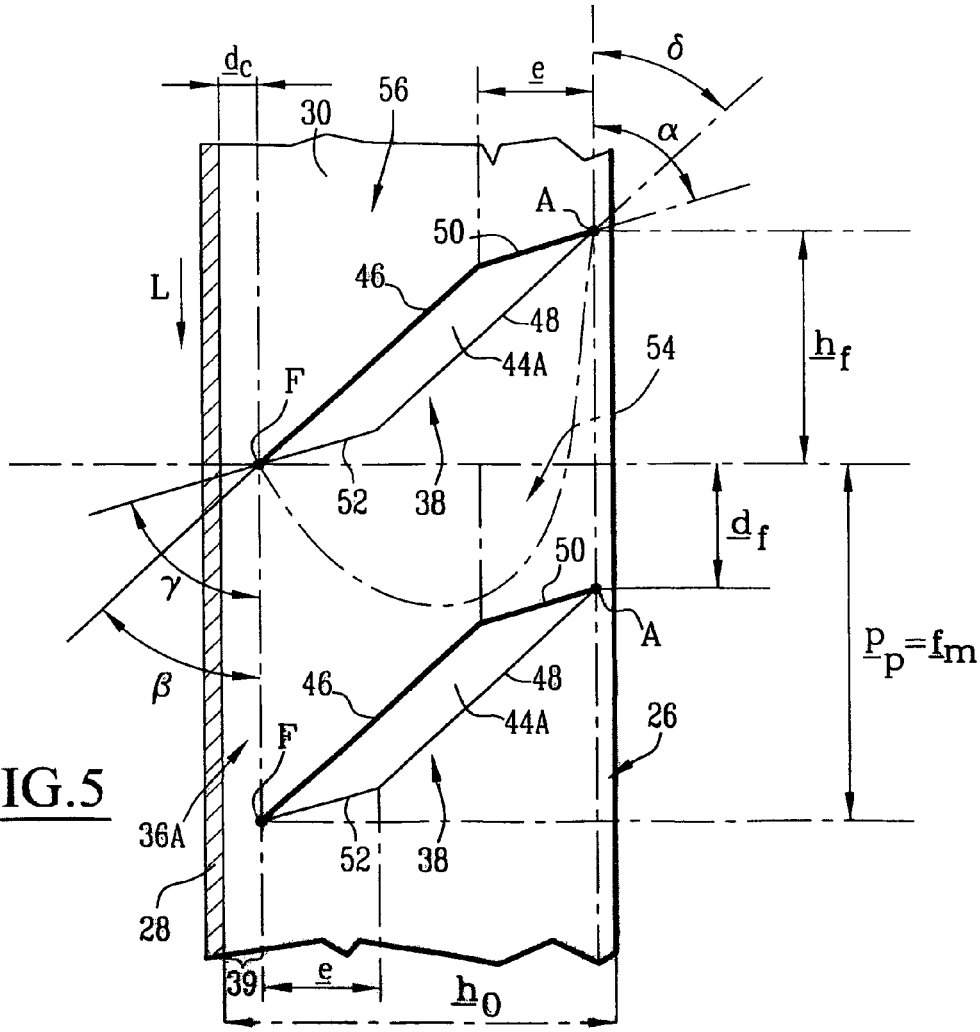
FIG. 5 illustrates a side view of the leg of the fin of FIG. 3.

For this purpose, each corrugation element leg 30 includes a region 39 of continuous material that extends within the corrugation element leg from the bottom 26 of the corrugation element or from the top 28 of the corrugation element to the start of the deflection member 38. This region 39, called a ribbon, has a width $d_c$ which is at least 0.2 mm and is preferably between 0.5 mm and 1 mm (see FIG. 5).

The bottom 26 and the top 28 of the corrugation element each consist of a strip of continuous material, devoid of liquid deflection members 38. Consequently, this strip forms a ribbon similar to the ribbon 39.

The first drainage channels 36A, 36B extend along the general nitrogen flow direction V.

Second drainage channels 42A, 42B are formed at points where the corrugation element legs 30 join the plate 11. These second drainage channels 42A, 42B are substantially identical to the first drainage channels 36A, 36B. However, their width is increased by the thickness of the corrugation element bottom 26 or corrugation element top 28 and by the layer of braze 32.

The liquid deflection members 38 consist of a succession of identical slots 44A, 44B of quadrilateral shape, in this case in the form of a non-rectangular parallelogram, which are provided in the corrugation element legs 30. The slots 44A are inclined toward the drainage channels 36A, 42A, in the general liquid flow direction L, whereas the slots 44B are inclined toward the drainage channels 36B, 42B.

Each slot 44A, 44B thus has two long edges, namely the leading edge 46 and the trailing edge 48, and two short edges, namely the leading edge 50 and trailing edge 52. The leading edges meet the trailing edges at leading A and trailing F junction points. In the case in which the fin 20 is manufactured from a perforated sheet, the edges of the slots are slightly rounded at the positions of the points A and F.

The width e of the slot, measured in a direction perpendicular to the flow direction L, is less than 2 mm and preferably between 0.1 and 1 mm.

The long 46 and short 50 leading edges are inclined relative to the general liquid flow direction L, toward the drainage channels 36A, 36B, 42A, 42B, at angles $\alpha$ and $\beta$, whereas the long 48 and short 52 trailing edges are inclined relative to this direction L at angles $\gamma$ and $\delta$. In the case of a parallelogram, $\alpha=\gamma$ and $\beta=\delta$ (see FIG. 5). The angles $\alpha$, $\beta$, $\gamma$ and $\delta$ are between 5° and 70° and preferably between 10° and 45°, these angles being measured relative to the general liquid flow direction L.

The angle of inclination $\alpha$ and $\beta$ of the leading edges 46, 50 is chosen according to the flow velocity of the liquid and to the viscosity of the condensed liquid in such a way that the drops of liquid adhere to the leading edges 46, 50 before being drained away to the point F via the drainage channels 36A, 36B, 42A, 42B.

In general, the trailing edges 46, 52 are arranged in such a way that the trailing junction point F between the long leading edge 46 and the short trailing edge 52 is, on the one hand, the forwardmost point of the trailing edge 48, 52 and is, on the other hand, the point on the edge of the slot 44A, 44B that is closest to the associated drainage channels 36A, 36B, 42A, 42B. Thanks to this configuration, the liquid flowing along the leading edge 46, 50 is prevented from being deflected toward the middle of the corrugation element leg 30 from the trailing junction point F.

The leading junction point A is placed as close as possible to the corrugation element bottom 26 or corrugation element top 28 and preferably coincides with this bottom or with this top.

In other words, the leading edge 46, 50 is at each point inclined in the direction L toward the associated drainage channel 36A, 36B, 42A, 42B. Preferably, the leading edge 46, 50 has an upwardly concave or straight shape and the trailing edge 48, 52 is at each point downwardly convex or straight.

The height $h_f$ of each slot 44A, 44B measured in the liquid flow direction L is chosen so as to weaken the structure of the fin 20 as little as possible. The height $h_f$ is for example between 0.5 mm and 20 mm and preferably between 5 mm and 15 mm.

The distance between two successive slots 44A, 44B is called $d_f$. This distance $d_f$ is the distance between the trailing point F of a slot 44A, 44B and the leading point A of the next slot 44A, 44B. This distance $d_f$ is chosen to be less than 5 cm and is preferably less than 20 mm.

The pitch between two successive slots 44A, 44B is called $p_f$ $(=h_f+d_f)$. This pitch $p_f$ is chosen in such a way that the surface of the corrugation element leg 30 is just rewetted over its height $h_0$ between two successive slots 44A, 44B. The degree of perforation, that is to say the ratio of the area of the perforations to the total area of the fin, is less than 15%.

During operation of the exchanger, a film 56 of liquid nitrogen is established, which flows over the surface of the fin 20. The liquid then encounters the leading edge 46, 50 of a slot 44A, 44B and is deflected toward a drainage channel 36A, 36B, 42A, 42B in such a way that a dried region 44 is established downstream of the slot 44A, 44B. Downstream of this slot 44A, 44B is again established, progressively, a liquid film 56 by condensation of gaseous nitrogen, which liquid is drained away by the next slot 44A, 44B.

The slots 44A, 44B reduce the thickness of the liquid film on the corrugation element leg 30 and consequently the heat-transfer resistance. They result, as a consequence, in an increase in the heat-exchange efficiency of the fin.

Figure 4:
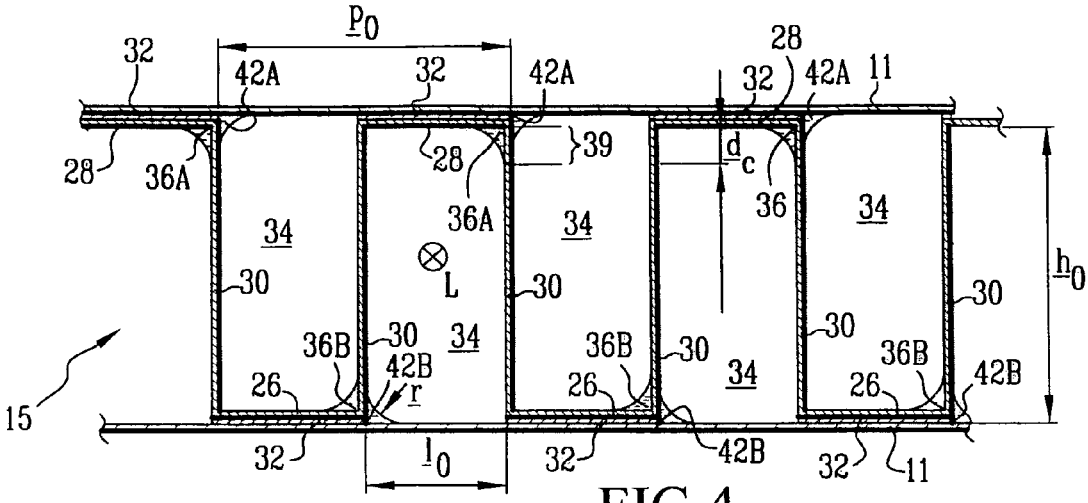
FIG. 4 illustrates a view of a condensation passage of the condenser-reboiler in cross section on the line IV-IV of FIG. 2.

As is apparent from FIG. 4, during operation, flows of liquid are established in the drainage channels 36A, 36B, 42A, 42B. The free surface for liquid flow in a drainage channel is in the form of a partial cylinder of radius r. The liquid flowing in the drainage channels 36A, 36B, 42A, 42B is prevented from leaving the latter by the capillary forces acting on the liquid. The drainability of the drainage channels is high owing to the fact that the radius r of the free surface for the liquid varies as the ¼ power of the liquid flow rate in the drainage channel in question.

Figure 6:
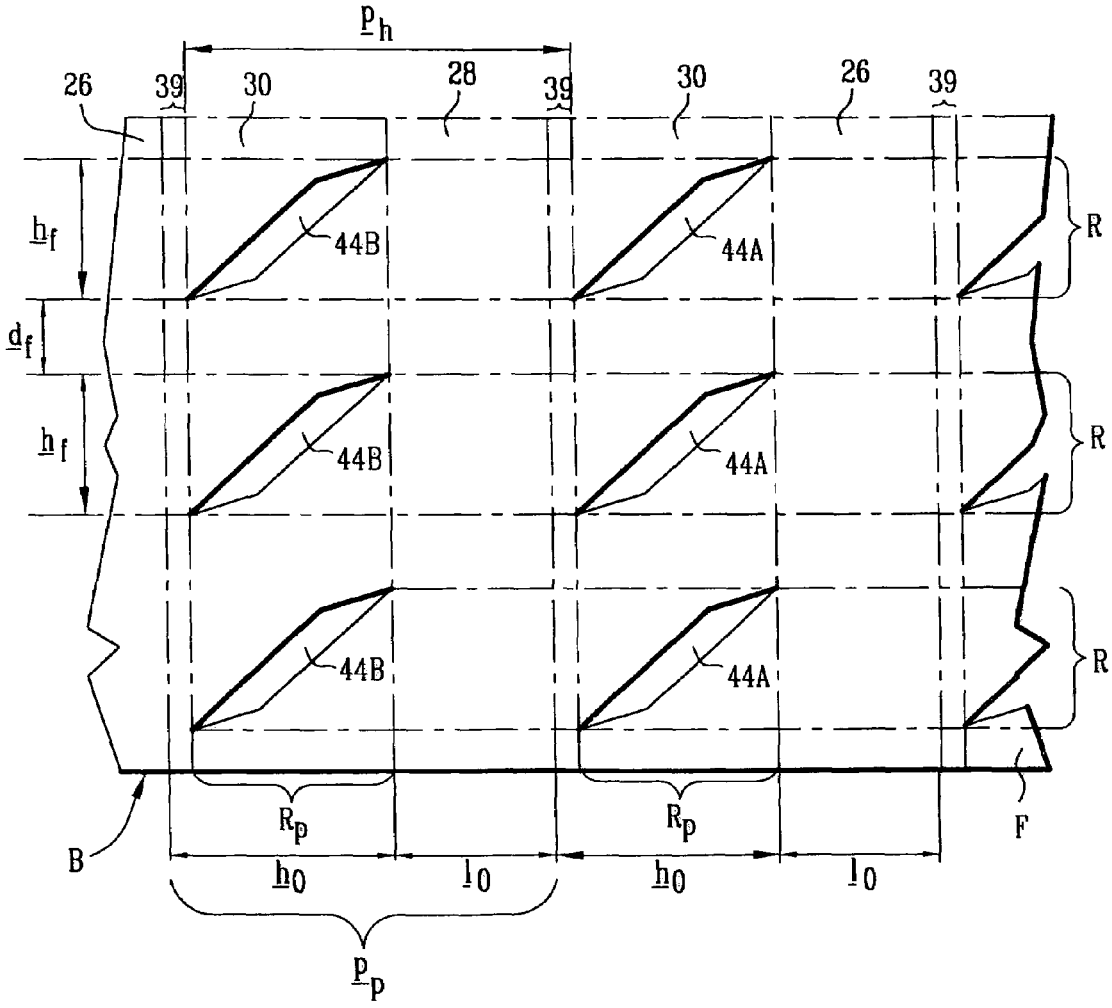
FIG. 6 illustrates a plan view of part of a blank for a fin according to FIGS. 3 to 5.

FIG. 6 shows a lower part of a blank F used to manufacture the fin 20.

The blank F has rows $R_p$ of slots 44A and 44B in regions corresponding to the corrugation element legs 30. These rows $R_p$ extend perpendicular to the lower edge B of the blank F.

The slots also form rows R extending parallel to the lower edge B and perpendicular to the lateral edges 31 of the corrugation element legs 30.

The pattern formed by the slots 44A, 44B is identical on all the corrugation element legs 30 and is reproduced with a periodicity $p_h$ identical to the folding periodicity $p_p$.

Thus, a single punch can be used to manufacture the slots 44A and 44B and this punch is driven synchronously with the tool for folding the blank.

Figure 7:
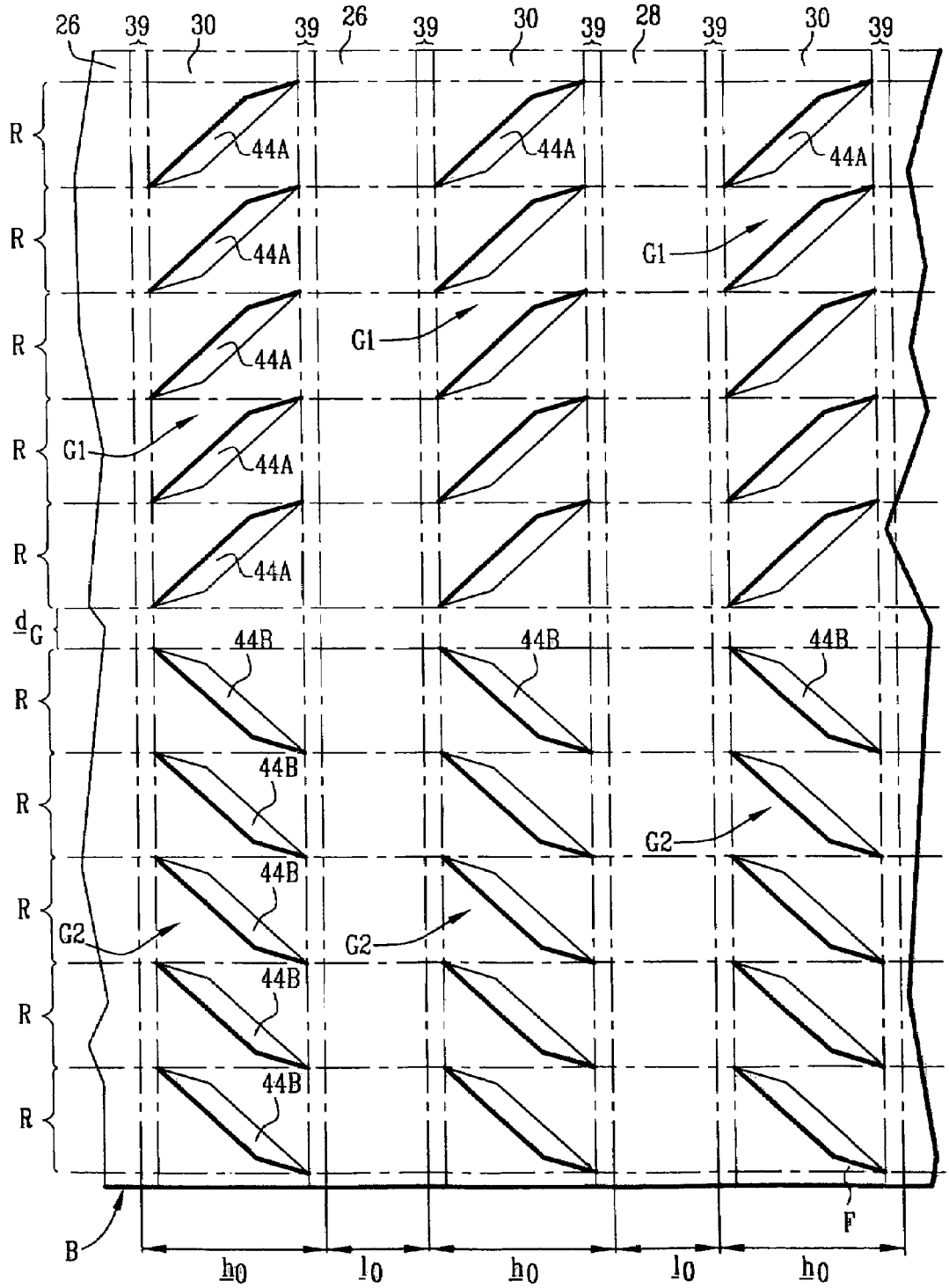
FIG. 7 illustrates a plan view of a blank for a first variant of a fin.

FIG. 7 shows part of a blank of a first variant of a spacer fin according to the invention.

Only the differences from the aforementioned fin will be described.

The blank F has, in each region corresponding to a corrugation element leg 30, first groups G1 of five successive first slots 44A and second groups G2 of five successive second slots 44B. The first slots 44A are inclined toward one side of the corrugation element leg 30, whereas the second slots 44B are inclined to the other side thereof.

The two groups G1, G2 are separated from each other by a distance $d_g$ of between 0.5 mm and 5 cm.

Each corrugation element leg 30 includes two ribbons 39 of continuous material, which are associated with the two lateral edges 31 of the corrugation element leg 30 and are adjacent to the bottom regions 26 or top regions 28.

Each slot 44A, 44B lies between these two ribbons 39.

Figure 8:
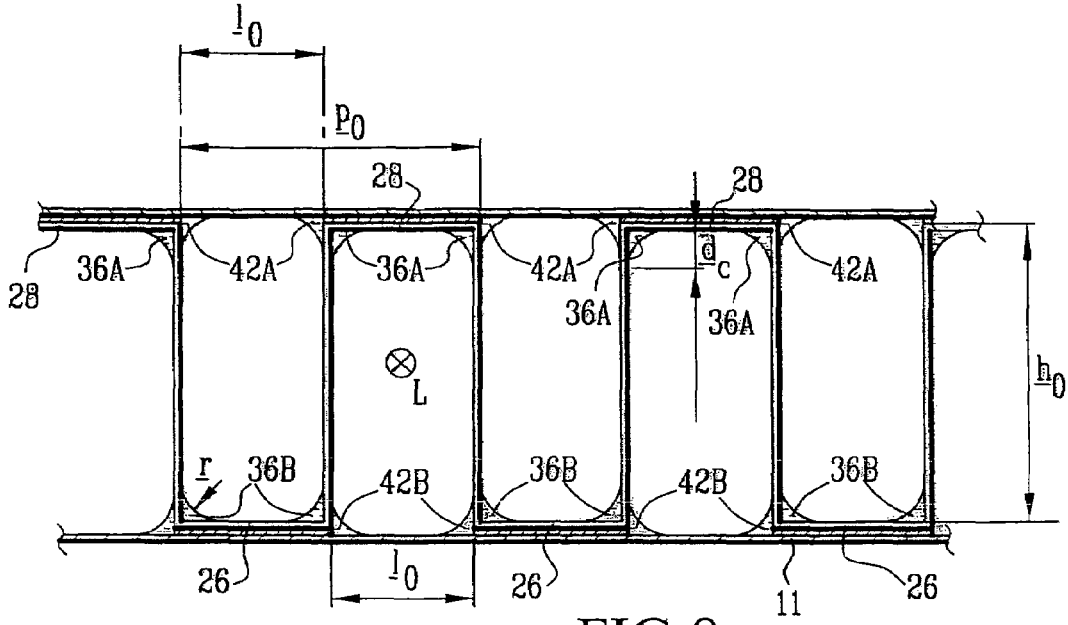
FIG. 8 illustrates a view of a condensation passage of the condenser-reboiler comprising a fin as in one of FIG. 7, 9 or 10.

During operation, the slots 44A deflect the liquid toward an edge of the corrugation element leg 30, while the slots 44B deflect the liquid toward the other edge of the leg (see FIG. 8).

Figure 9:
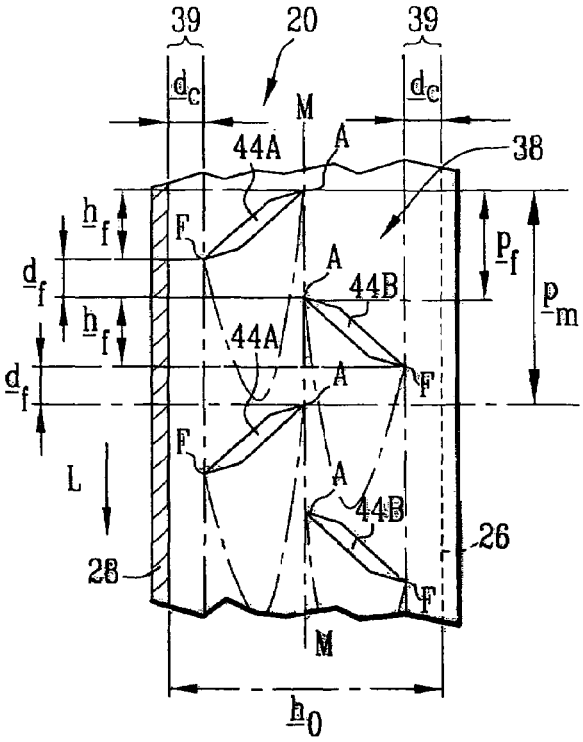
FIG. 9 illustrates a view similar to FIG. 5 of a second and a third embodiment variant, respectively, of the fin.

FIG. 9 shows a second variant of the fin 20 according to the invention. This figure corresponds to the view in FIG. 5. Analogous elements bear identical references.

The liquid deflection members 38 are formed by a succession of first slots 44A and second slots 44B. The first and second slots lie on each corrugation element leg 30 on either side of a mid-line M-M of said leg.

This line M-M lies parallel with the liquid flow direction L, at mid-distance between the corrugation element top 28 and the corrugation element bottom 26 of the fin 20.

The first slots 44A are inclined to the mid-line M-M toward the corrugation element tops 28, whereas the second slots 44B are inclined toward the corrugation element bottoms 26. The first slots 44A and the second slots 44B are symmetrical in shape with respect to the mid-line M-M.

The trailing junction point F of each slot 44A, 44B is located at a distance $d_c$ from the top 28 and from the bottom 26, respectively. This fin 20 includes first drainage channels 36A, 36B on both sides of each corrugation element leg 30.

The leading junction point A of each slot 44A, 44B lies on the line M-M. Thus, substantially the entire width of the leg 30 is provided with drainage slots 44A, 44B.

During operation and as shown in FIG. 8, the liquid is deflected toward the top 28 and the bottom 26 associated with each leg 30, toward the drainage channels 36A, 36B and 42A, 42B.

Each of the first 44A or second 44B slots is offset relative to the first or second following slot by a distance $p_f$.

In other words, the pattern formed by the combination of two slots 44A, 44B is repeated after a distance $p_m$.

The distance $d_f$ between the point F of a slot 44A, 44B and the point A of a following slot 44B, 44A is between 0 mm and 2.5 cm.

The first slots 44A are offset relative to the second slots 44B by a distance $p_f = p_m/2$ in the flow direction L.

This offset results in considerable strength of the fin 20 in the direction of the corrugation element leg 30.

Figure 10:
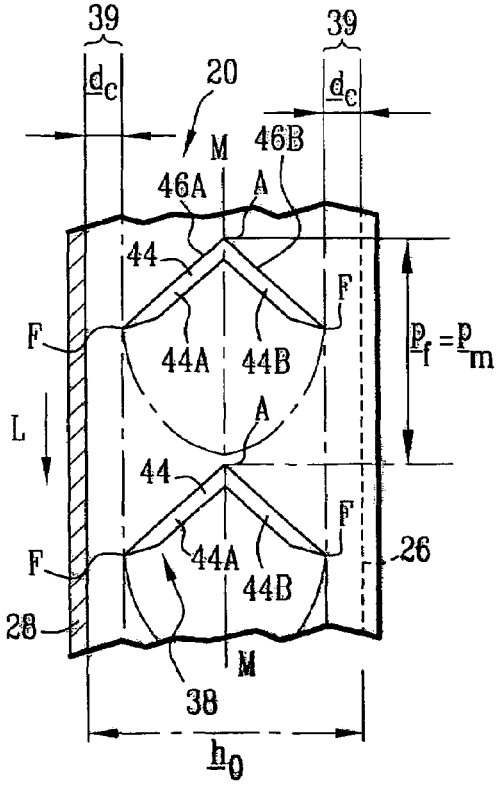
FIG. 10 illustrates a view similar to FIG. 5 of a second and a third embodiment variant, respectively, of the fin.

FIG. 10 shows a third variant of the fin according to the invention.

The slots 44 of this fin 20 are substantially in the form of a chevron. The point A of the chevron lies on the mid-line M-M and is directed upstream relative to the general liquid flow direction L.

The two arms 44A, 44B of the chevron have a shape substantially identical to the first 44A and second 44B slots of the first variant of the fin 20. The difference is that the leading edge 46A, 46B of each arm is straight from the leading point A as far as the trailing point F. During operation, the liquid flow is established on both sides of each corrugation element leg 30, in a similar manner to that of the second variant (FIG. 8).

Each chevron-shaped slot (FIG. 10) is either cut out by a corresponding chevron-shaped punch, or by two separate punches, each of which corresponds to one arm 44A, 44B of a slot 44. In the latter case, the slot 44 is cut out in two successive steps.

Figure 11:
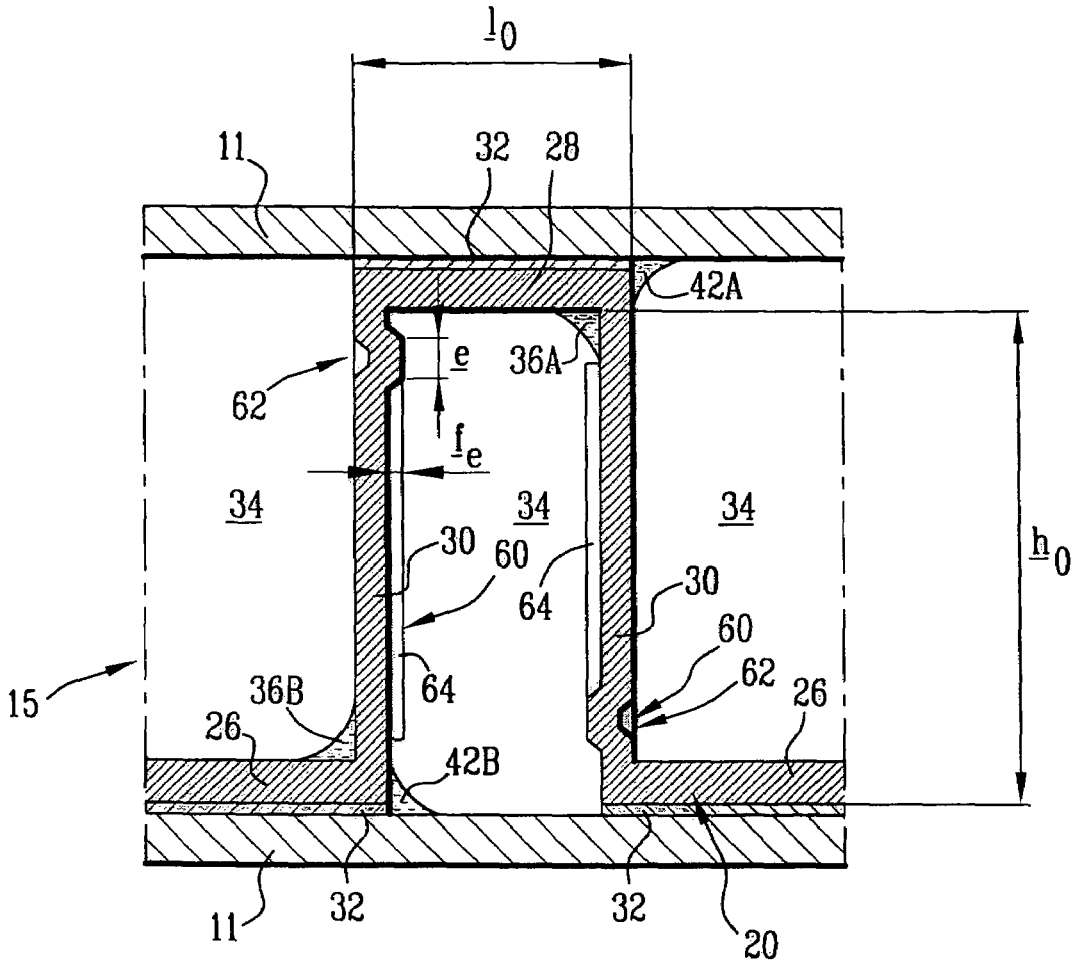
FIG. 11 illustrates a sectional view of a condensation passage comprising a fin in a second embodiment.

FIG. 11 shows a second embodiment of a fin according to the invention. This view corresponds to the view of FIG. 4, but shows only one corrugation element.

The difference is that the liquid deflection elements 38 consist of dished parts 60 in the surface of the corrugation element legs 30. The dished parts 60 form, on one side of the corrugation element leg, a groove 62 and on the other side of the corrugation element leg a rib 64.

The shape and the geometrical configuration of the dished parts 60 in side view are identical to those of the slots 44A, 44B of the embodiments of the fin described above.

The depth of drawing $f_e$ of the dished part 60 is less than one half of the corrugation element width $l_o$ and is, for example, between 0.1 mm and 0.25 mm.

The heat-exchange fin according to the invention can be easily manufactured from a flat product, for example a sheet of aluminum.

The slots 44, 44A, 44B are then produced by perforation.

Alternatively, the dished parts 60 are formed by drawing before the flat product is folded. Preferably, the drawing is carried out on only one side, so that the grooves 62 lie on one side of the blank. In this case, each channel 34 has, on both its side faces, formed by the corrugation element legs 30, either deflection grooves 62 or deflection ribs 64.

As a variant, the deflection members 38 are manufactured on a fin of the "serrated" type, i.e. a fin having corrugations with a partial offset. In this case, the length of the corrugations in the general liquid flow direction must be large enough to wet the surface of the leg. The length of the corrugation, also called the serration length, in the liquid flow direction L must be at least 3 mm and preferably at least 1 cm.

The fin may also be used in a heat exchanger in which a gas mixture flows through the cooling passages and in which a fraction of the mixture is condensed.

Again as a variant, the fin may consist of two or more fin parts placed one after another in the general liquid flow direction. In this case, it is advantageous for the drainage means 36A, 36B, 38 to have a different drainability from one fin part to another and for the drainability to increase from one fin part to the next fin part in the drainage fluid flow direction. An example of such a fin is a spacer fin that comprises a first fin part provided with drainage channels 36A, 36B and with drainage members 38 and a second fin part, which is located downstream in the liquid flow direction L, comprising smooth corrugation element legs 30.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus, comprising:

a) a corrugated element with a cross section defined by corrugation legs;

b) a plurality of flow channels to condense a gas, said flow channels defined by said legs;

c) one or more drainage channels, for liquid condensed on said legs, extending along a lateral edge of said leg; and d) one or more deflection members located on said legs, wherein said deflection members deflect said liquid toward said one or more drainage channels, said deflection members comprising at least one slot, wherein each slot defines a nonrectangular parallelogram having at least one of:

1) a leading edge inclined toward said one or more drainage channels; and 2) a trailing edge inclined toward said one or more drainage channels.

2. The apparatus of claim 1, wherein said cross section is rectangular.

3. The apparatus of claim 1, wherein:

a) each said deflection member drains said liquid toward a single lateral edge of said corrugation leg; and b) said deflection members of two successive corrugation legs drain said liquid toward two opposed lateral edges.

4. The apparatus of claim 1, wherein said deflection members drain said liquid toward both lateral edges.

5. The apparatus of claim 1, further comprising corrugation legs wherein:

a) deflection members are located over the portions of said corrugation legs that are not associated with said one or more drainage channels; and b) no deflection members are located on the portions of said corrugation legs that are associated with said drainage channel.

6. The apparatus of claim 1, further comprising:

a) a corrugation element top;

b) a corrugation element bottom;

c) a first drainage channel, of the one or more drainage channels, associated with said element bottom;

d) a second drainage channel, of the one or more drainage channels, associated with said element top;

e) at least one first deflection member, wherein said first member is inclined toward said first drainage channel associated with said element bottom; and f) at least one second deflection member, wherein said second member is inclined toward said second drainage channel associated with said element top.

7. The apparatus of claim 6, wherein:

a) each said deflection member drains said liquid toward a single lateral edge of said corrugation leg;

b) said deflection members of two successive corrugation legs drain said liquid toward two opposed lateral edges; and c) said deflection members of two adjacent corrugation legs consist of:

1) only said first members on the first of said corrugation legs; and 2) only said second members on the second of said corrugation legs.

8. The apparatus of claim 6, wherein:

a) said deflection members drain said liquid toward said lateral edges;

b) said first members and said second members extend over substantially the entire height of said corrugation leg; and c) each said corrugation leg further comprises:

1) a first group consisting of adjacent first members; and 2) a second group consisting of adjacent second members.

9. The apparatus of claim 6, wherein said first and said second members are symmetrical with respect to a mid-line of said corrugation leg.

10. The apparatus of claim 9, wherein said first members are offset from said second members by about one half the distance between two adjacent said first or said second members.

11. The apparatus of claim 10, wherein said offset is with respect to the general liquid flow direction.

12. The apparatus of claim 9, wherein said first and said second members are oriented opposite each other along said mid-line.

13. The apparatus of claim 12, wherein said first and said second members form a chevron shape.

14. A method of manufacturing the apparatus of claim 13, comprising:

a) making parallel rows of said deflection members in a blank of flat product;

b) creating the first branches of said chevron in said blank before creating the second branches of said chevron in said blank; and c) bending plastically said product to form corrugations wherein said deflection members of a said row are located on said corrugation legs.

15. The apparatus of claim 1, wherein the orientation of said deflection members is such that, when said corrugated element is unfolded, said deflection members comprise rows, wherein:

a) said rows are parallel to an edge of said apparatus;

b) said rows are perpendicular to edges of said corrugation leg; and c) said deflection members of a said row are identical.

16. The apparatus of claim 6, wherein said deflection members comprise at least one member selected from the group consisting of:

a) a projecting part on the surface of said corrugation leg; and b) a set back part with respect to said surface.

17. The apparatus of claim 16, wherein said set back part comprises a dished part.

18. The apparatus of claim 16, wherein all said deflection members for said flow channel are of said projecting part type.

19. The apparatus of claim 16, wherein all said deflection members for said flow channel are of said set back part type.

20. The apparatus of claim 1, wherein the distance between adjacent deflection members, in the general liquid flow direction, is less than about 5 cm.

21. The apparatus of claim 1, wherein the distance between adjacent deflection members, in the general liquid flow direction, is less than about 20 mm.

22. The apparatus of claim 6, wherein each drainage channel further comprises:

a) a continuous strip of material from said corrugation leg adjacent to said deflection members; and b) a continuous strip of material on at least one member selected from the group consisting of:

1)said corrugation element top; and 2)said corrugation element bottom.

23. The apparatus of claim 6, wherein the general liquid flow direction is substantially the same as the general fluid flow direction in said gas flow channels.

24. The apparatus of claim 6, further comprising partially offset corrugations wherein the distance between adjacent said offsets is at least about 3 mm.

25. The apparatus of claim 24, wherein said distance is at least about 1 cm.

26. The apparatus of claim 6, further comprising at least two fin parts wherein:

a) each said fin part has a different drainage capacity; and b) said capacity increases from one fin part to the next fin part in the general fluid flow direction.

27. An apparatus comprising:

I) a plurality of heating passages; and

II) a plurality of gas condensation passages in thermal communication with the plurality of heating passages, each gas condensation passage comprising:

a) one or more lateral closure bars; and b) at least one heat exchange space fin, said fin comprising:

1) a corrugated element with a cross section defined by corrugation legs;

2) one or more flow channels to condense a gas, said flow channels defined by said legs;

3) one or more drainage channels, for liquid condensed on said legs, extending along a lateral edge of said leg; and 4) one or more deflection members located on said legs, wherein said deflection members deflect said liquid toward said one or more drainage channels, said deflection members comprising one or more slots, wherein each slot defines a nonrectangular parallelogram having at least one of:

i) a leading edge inclined toward said one or more drainage channels; and ii) a trailing edge inclined toward said one or more drainage channels.

28. The apparatus of claim 27, wherein said one or more gas condensation passages comprise at least one member selected from the group consisting of:

a) partial condensation passages; and b) complete condensation passages.

29. An apparatus comprising:

I) a gas manifold defining an enclosure;

II) a heat exchanger, fluidly coupled to the gas manifold, comprising:

A) a plurality of heating passages; and

B) a plurality of gas condensation passages in thermal communication with the plurality of heating passages, each gas condensation passage comprising:

a) one or more lateral closure bars; and b) at least one heat exchange space fin, said fin comprising:

1) a corrugated element with a cross section defined by corrugation legs;

2) one or more flow channels to condense a gas, said flow channels defined by said legs;

3) one or more drainage channels, for liquid condensed on said legs, extending along a lateral edge of said leg; and 4) one or more deflection members located on said legs, wherein said deflection members deflect said liquid toward said one or more drainage channels, wherein said deflection members comprise one or more slots, wherein each slot defines a nonrectangular parallelogram having at least one of:

i) a leading edge inclined toward said one or more drainage channels; and ii) trailing edge inclined toward said one or more drainage channels;

and

III) a liquid manifold, fluidly coupled to the heat exchanger, for receiving liquid collected in the one or more drainage channels.

30. A method of condensing a gas, comprising:

I) providing a heat exchanger, the heat exchanger comprising:

A) a plurality of heating passages; and

B) a plurality of gas condensation passages in thermal communication with the plurality of heating passages, each gas condensation passage comprising:

a) one or more lateral closure bars; and b) at least one heat exchange space fin, said fin comprising:

1) a corrugated element with a cross section defined by corrugation legs;

2) one or more flow channels to condense a gas, said flow channels defined by said legs;

3) one or more drainage channels, for liquid condensed on said legs, extending along a lateral edge of said leg; and 4) one or more deflection members located on said legs, wherein said deflection members deflect said liquid toward said one or more drainage channels;

II) flowing a fluid through the a plurality of heating passages;

III) flowing a gas through the a plurality of gas condensation passages, such that heat is transferred from the gas to the fluid, wherein at least a portion of the gas is condensed to a liquid, and wherein the liquid is deflected into the drainage channel by the one or more liquid deflection members; and IV) collecting the liquid from the drainage channel.

31. The method of claim 30, wherein said condensation passages further comprise at least one member selected from the group consisting of:

a) partial condensation passages; and b) complete condensation passages.

32. The method of claim 30, wherein each deflection member comprises a slot defining a nonrectangular parallelogram.

33. The method of claim 32, wherein each slot comprises at least one of:

a) a leading edge inclined toward said one or more drainage channels; and b) a trailing edge inclined toward said one or more drainage channels.

* * * * *